US006442960B1

(12) United States Patent
Fournier et al.

(10) Patent No.: US 6,442,960 B1
(45) Date of Patent: Sep. 3, 2002

(54) AUTONOMOUS GRAVITY-FEED BEVERAGE DISPENSER WITH COOLING DEVICE

(75) Inventors: Eric Fournier, Varennes-sur-Allier; Jean-Marc Ritter, Berzet, both of (FR)

(73) Assignee: Dieau S.A., Cebazat (FR)

( * ) Notice: Subject to any disclaimer, the term of this patent is extended or adjusted under 35 U.S.C. 154(b) by 0 days.

(21) Appl. No.: 09/830,583

(22) PCT Filed: Oct. 12, 1999

(86) PCT No.: PCT/FR99/02463

§ 371 (c)(1),
(2), (4) Date: Sep. 10, 2001

(87) PCT Pub. No.: WO00/27744

PCT Pub. Date: May 18, 2000

(30) Foreign Application Priority Data

Nov. 9, 1998 (FR) ..... 98 14429

(51) Int. Cl.[7] ..... B67D 5/62

(52) U.S. Cl. ..... 62/390; 222/146.6; 222/185.1; 62/391

(58) Field of Search ..... 222/146.6, 185.1, 222/189.09, 108, 481; 62/389–391

(56) References Cited

U.S. PATENT DOCUMENTS 4,723,688 A 2/1988 Munoz
4,923,091 A * 5/1990 Sutera ..... 222/146.6
5,222,531 A * 6/1993 Baker et al. ..... 222/185.1
5,590,532 A 1/1997 Bachman
5,979,709 A * 11/1999 Liccioni ..... 222/146.6

FOREIGN PATENT DOCUMENTS

GB 2 204 670 11/1988

* cited by examiner

*Primary Examiner*—Philippe Derakshani
(74) *Attorney, Agent, or Firm*—Arent Fox Kintner Plotkin & Kahn, PLLC

(57) ABSTRACT

A gravity-feed unit that dispenses cool drinks form a carboy includes a breakable inner seal. The carboy is supported by its neck, which is centered on a striker. The striker includes a discharge passage for the carboy that communicates with a coiled pipe to cause the beverage to flow through a secondary exchanger. A heat transferring agent is previously cooled in a primary exchanger and brought to the secondary exchanger by a pump. Actuation is controlled by a temperature sensor that measures the temperature of the heat transfer agent in the secondary exchanger. The primary exchanger includes a heat source that causes the heat transfer agent to pass continuously inside a closed circuit mutually connecting the primary and secondary exchangers regardless of whether the pump is operating.

11 Claims, 1 Drawing Sheet

AUTONOMOUS GRAVITY-FEED BEVERAGE DISPENSER WITH COOLING DEVICE

BACKGROUND OF THE INVENTION

1. Field of the Invention

The invention is in the field of gravity-feed beverage dispensers based on a storage container; it relates to a self-contained dispenser of a chilled beverage into a cup, in particular on the basis of a removable necked storage carboy.

2. Description of Related Art

Beverage dispensers designed to be installed in a collective space, workplace, or place frequented by visitors have been disclosed. In particular, among these dispensers ones have been disclosed which comprise a reserve of treated beverage kept under pressure in an elevated inverted position for gravity feed of the beverage which a dispenser contains. A carboy may be removed for the purpose of being replaced when it is empty, and the dispenser includes percussion means for the sealing cap of an installed carboy. Once the cap has been perforated, the beverage is drained by gravity toward a conduit for delivery of the beverage to a dispensing tap, after it has passed through refrigeration means to chill it. Customarily the refrigeration means comprises an exchanger made up of a coil carrying a liquid refrigerated by a source of cold. The coil is wound around a tank mounted between the perforation means and the beverage dispensing tap, through the interior of which tank the beverage passes and in which heat exchange takes place between the beverage and the refrigerating liquid. It will be found that such dispensers often have an additional beverage delivery conduit which communicates with the percussion means and a tap for supplementary dispensing of beverage at ambient temperature, that is, without intermediate passage of the beverage into refrigeration means.

In order to acquaint oneself with a technological environment similar to that of the invention, one may refer to patent applications FR2769610 (Mistral Distribution AS) or EP0581491 (EBAC Ltd).

The first problem to be solved resides in the fact that the refrigeration means should offer a beverage chilling capacity commensurate with the peak consumption, which, after all, is greater because the ambient temperature, and accordingly that of the beverage stored, is higer.

Conversely, on the other hand, it is not desirable for the capacity of these refrigeration means to lead to disproportionate dispenser operating costs, considering the fact that these means are kept in operation over periods during which consumption of the chilled beverage is episodic and irregular.

Another problem lies in the fact that beverage dispensing by carboy involves frequent maintenance because of the requirements of hygiene, with the resulting maintenance cost for such devices, because of the possible presence of strains of bacteria in the beverage dispensing system and of stagnation of discharge of the beverage in areas in which the dispenser is kept. Lastly, in the event of unforeseen pollution of the device by a contaminated carboy, spontaneous evacuation of impurities is not guaranteed by simple gravity flow of the beverage over its dispensing circuit, especially since the heat exchange capacity in question, in the form of a tank or a bag, favors retention of the beverage inside certain areas of its filling capacity containing beverage being chilled.

Also known in the area of beverage dispensing is prior art remote from that referred to above, consisting of a device for dispensing a plurality of beverages from individual tanks kept under pressure, for a beverage dispensing counter, for example. In order to avoid provision of each of these tanks with a refrigeration source of its own, GB2204670 (MK Refrigeration) has proposed a dispenser of the type comprising a refrigeration source common to all the beverage tanks to be refrigerated, in a first refrigeration stage, a liquid heat transfer refrigeration liquid which is then taken to second refrigeration stages mounted in parallel in a closed circuit comprising a pump for circulation of the heat transfer liquid. Each of the beverages, kept under pressure in the corresponding tank, circulates inside a coil through a refrigeration compartment of a second refrigeration stage. Thermostatic means assigned to each of such second refrigeration stages for measurement of beverage temperature if necessary order operation of an intake valve for admission of the heat transfer liquid to the refrigeration compartment of a particular beverage.

SUMMARY OF THE INVENTION

The object of this invention is to propose a gravity-feed cold-beverage dispenser based on a removable storage carboy, the competitive nature of which invention is based on reduction of maintenance costs, especially from the viewpoint of hygiene, both by reducing the frequency of maintenance intervention operations and by reducing the number of operations to be carried out during such intervention, and on-a satisfactory beverage refrigeration capacity during peak periods, with nevertheless low latent operating costs.

BRIEF DESCRIPTION OF THE DRAWING

The invention will be described with reference to the FIGURE in the attached drawing, which presents a diagram of a beverage dispenser in a preferred embodiment of the invention.

DETAILED DESCRIPTION OF THE INVENTION

Figure 1:
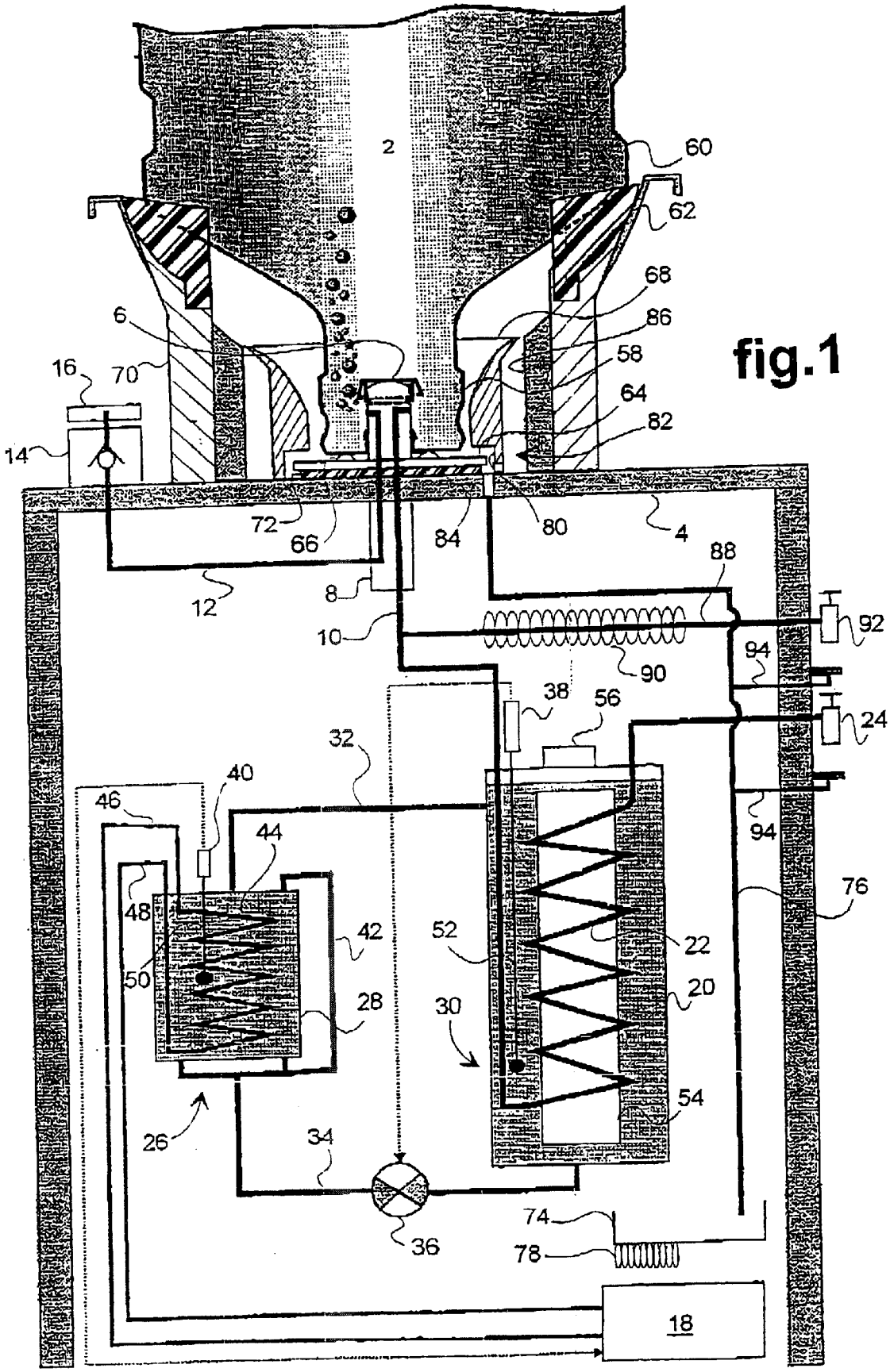

In accordance with the invention and on the basis of the foregoing statements of problems to be solved, statements which themselves emphasize the inventive advance made by the designers with the corresponding arbitrary choice which they propose, a beverage dispenser has the following characteristics, considered either singly or in combination.

1. The dispenser, a gravity-feed chilled beverage dispenser, is made up chiefly of:

(a) stand 4 extending vertically, (b) means for supporting a removable inverted charged container 2, such container being in the form of a narrow-necked carboy, (c) means of striking a sealing cap 6 for the carboy 2, comprising a vertically extending striking pin having at least one duct 10 for drainage of the beverage from the carboy 2, such striking pin 8 also having a duct 12 for admission of air communicating with the exterior by means of a beverage check valve 14 and an air filter 16, (d) a beverage refrigeration device comprising a source of cold 18 for refrigeration of a heat transfer agent kept in balance between its liquid and solid phases, a beverage chilling compartment 20 in which exchange of heat between such agent and the beverage takes place, and a chilled beverage dispensing line 22 communicating with such beverage drainage duct 10, a line provided with at least one tap 24 for drawing off the chilled beverage, (e) electric power supply means (not shown in the figure).

2. The refrigeration device is made up of:

(a) a primary heat exchanger 26 in which chilling of the heat transfer agent is effected, such primary heat exchanger 26 comprising a primary exchange compartment 28 containing such heat transfer agent, which is intended to be in equilibrium with its solid phase and the cold source 18, (b) a secondary exchanger 30 comprising a secondary exchange compartment 20 containing the heat transfer agent and at least in part the chilled beverage dispensing pipe 10-22, the latter being in the form of a coiled pipe 22 extending vertically and in particular having a diameter approximately two to five times the diameter of the coiled pipe, (c) a closed hydraulic circuit comprising primary compartment 26 and secondary compartment 30 connected to each other by pipes designated as intake 32 and return 34 for carrying the transfer agent between primary 26 and secondary 30 exchangers by means of a pump 36 mounted in the circuit, on return pipe 34, for example, (d) thermostatic means 38 situated in the secondary compartment 20 for measurement of the temperature of the transfer agent present, such thermostatic means 38 constituting control means for starting or stopping the pump 36 in order to cause or suspend circulation of the agent in the closed circuit, and (e) means for ensuring coexistence of liquid and solid phases of the heat transfer agent comprising, preferably in combination, thermostatic means 40 mounted in the primary compartment for activating or suspending production of cold by such cold source 18, and a heat source 42, preferably a static or ambient source, unless produced in particular on the basis of a mounted source of electric energy, such heat source 42 constituting means of ensuring continuity of passage of liquid transfer agent.

These provisions are such that the pump is not permanently activated, being engaged only to meet the needs of users on demand, its activation depending on the temperature of the transfer agent inside the secondary compartment making it possible to obtain cold beverage at any time, including a peak period, without this leading to untimely operating costs during periods when chilled beverage is not drawn off.

In addition, the preferred configuration of the chilled beverage dispensing circuit as a coiled pipe 22 with significant axial extent of at least twice its diameter imparts to the beverage it carries a dynamic of its own in evacuation of contaminating substances unforeseeably or accidentally present in the beverage dispensing circuit, this making it possible to schedule sanitary inspections of the dispenser and dispenser cleaning operations at longer intervals, this resulting in lower maintenance and related costs.

It is to be noted, lastly, that the layout of the closed circuit 28, 32, 20, 36, 34 and of the primary 26 and 30 exchangers, with their operating means, and especially with activation of the pump 36 or not on the basis of the temperature of the transfer agent inside the secondary compartment 20, and with continuity maintained in the cycle of liquid passage of the heat transfer agent by static means 42 represented by an ambient heat source, and layout of the closed circuit associated with configuration of the chilled beverage dispensing circuit line as a coiled pipe 22 mounted in the secondary exchange compartment 20, a pipe of significant axial extent of at least twice its diameter, impart to the secondary exchanger 30 low inertia of operation after transition from peak or sporadic operation and transition to peak operation, and yield a good result in refrigeration of the beverage during a peak period, while offering satisfactory competitive operation.

It will be seen that, as one aspect of the invention aimed at lowering the operating costs of the device, it is proposed that the pump 36 be made subject to control means 38 causing operation to be discontinued when the desired temperature of the heat transfer agent is reached inside the secondary compartment 20, and that these control means 38 be associated first with thermostatic means 40 mounted inside the primary compartment 28 in order to halt production of cold when a low-temperature threshold is reached, between −1° C. and −5° C. in particular, and secondly with such heat source 42 for maintaining continuous passage of liquid in the circuit of the heat transfer agent, in order to offset the inertia associated with passage of the agent between its liquid and solid phases, which inertia creates the risk of interruption of such continuity despite the halting of production of cold ordered by the thermostatic means 40 of the primary compartment 28.

It will thus be seen that, because of the presence of heat source 42 and continuity of passage of heat transfer liquid inside the closed circuit, lowering of the temperature inside the primary exchanger is authorized, even to the point of transformation of the transfer agent to the solid phase in order to meet the requirements of satisfactory cold beverage withdrawal during peak periods without the need for permanent circulation of the transfer agent in the closed circuit. In addition, the option offered of lowering the temperature of the transfer agent presents the possibility of impeding the development of layers of bacteria inside the coiled pipe carrying chilled beverage inside the secondary exchanger.

It will be noted that in a conventional embodiment in the sphere of heat exchangers such source of cold consists, for example, of a coiled pipe 44 forming the evaporator of a source of cold production.

In one embodiment of such static heat source, this source is represented by extension into the primary compartment 28 of at least one of the delivery 32 and return 34 pipes of the heat transfer agent which connect the primary 28 and secondary 20 compartments to each other, these pipes 32 and 34 drawing their heat from ambient air. In addition, as a supplement to, but preferably as a substitute for such extensions of the delivery 32 and return 34 pipes, this static heat source is represented by a derivative circuit 42 of the heat transfer agent serving the purpose of keeping outside the primary compartment 28 an amount of heat transfer agent present inside such closed circuit, and thus an amount not subject to refrigeration in the primary exchanger 26 and so remaining in the liquid state.

In one advantageous embodiment such derived circuit 42 forms with the primary compartment 28 a single assembly formed by blow molding of a plastic material around rigid intake 46 and discharge 48 lines of the coiled pipe 44 and around a tube housing 50 the corresponding thermostatic means, the coiled pipe 44 being positioned inside the primary compartment 28, which contains the heat transfer agent. Note is to be made of the preferred elliptical configuration of the primary chamber 28, the purpose being to move such derived circuit 42 away from the central area of the primary compartment 28 in which the coiled pipe 44 is situated. It will be noted in this connection that the secondary compartment is made in a similar manner, that is, with the coiled pipe 22 kept between the two shells of a mold having recesses for the passage of the delivery 32 and return 34 lines for the heat transfer agent, as well as tube 52 to receive the thermostatic means 38, inside which mold a plastic cylinder is blow molded. Also to be noted is the presence inside the secondary compartment of an element 54 inserted between the turns of the coiled pipe before blow molding and occupying the interior space of the beverage drain coiled pipe 22 to limit the capacity of the secondary compartment 20, which is reserved for the heat transfer agent.

According to another feature intended to simplify maintenance operations, in particular replacement and/or addition of heat transfer agent, and intended to lower operating costs associated with the pump 36, this closed circuit is made up of primary 28 and secondary 20 compartments, as well as these delivery 32 and return lines 34, the pump being mounted on any of the latter, and the closed circuit 28, 32, 20, 34, 36 is kept under atmospheric pressure, the pump 36 representing only means of circulating fluid offering the advantage of being silent, as well as that of low wear and low energy consumption. It is advantageous for this purpose for at least one of primary 28 and/or secondary 20 compartments to be provided with a filling plug 56 equipped with a semipermeable membrane for communication with ambient air. It is to be seen in the figure that the interior volume of the secondary compartment 20 is not totally occupied by such agent, but includes a part occupied by ambient air to absorb variations in the volume of the heat transfer agent. It is also to be noted that water is a suitable heat transfer agent.

3. The carboy 2 is kept loaded by the stand 4 in inverted position by means of its neck 58, which rests on a base 64, 66 of the striker 8, on which striker 8 the neck is aligned for centering of the carboy 2 on the stand 4 by means of its neck. The body 60 of the carboy is in contact with the stand 4 for beverage dispensing by means of flexible organs 62 which constitute means for absorption of the tolerances and the geometric imperfections of the body 60 of the carboy 2.

A layout such as this of the means of support 64, 64 and centering 8, 62 of the carboy 2 on the dispenser by means of its neck 58 tends to reduce the risk of leaks through spontaneous prevention of harmful misalignment of the carboy 2 on the striker 8 and by repercussion of the carboy 2 on the stand 4 in a concentrated axial zone of the stand, this limiting the effect of the weight of the carboy 2 on peripheral areas of the stand 4 which could impair the stability of the latter. In addition, positioning of the carboy on the stand by way of its neck provides the possibility of using a short striker which is totally covered by the carboy whatever the dimensions of the latter, and, lastly, the striker is insulated from the external environment when a carboy is positioned on the dispenser, this tending to reduce this risks of pollution.

It is to be noted also that these provisions result first of all in reduction of the risk of pollution caused by stagnation of beverage in the dispenser because of such reduction of the risk of leakage, secondly in appropriate emptying of the carboy because of its centering by means of its neck, and thirdly in the possibility of using a single dispenser with carboys from any supplier because of flexible support of the body of the carboy by the stand permitting acceptance to a certain extent of differences in carboy size from one supplier to another.

The flexible elements 62 referred to are made up, for example, of a cushion of a flexible material which forms a flexible seat for the body 60 of the carboy 2, and which preferably has tapering bearing surfaces.

In a preferred embodiment the neck 58 of the carboy 2 rests axially against a plate 64 integral with the striker 8 forming the seat in question, by means of blocks 66 with which the latter is provided, so that the carboy 2 is held in inverted position by at least three points, preferably with a spherical bearing surface supporting its neck 58 on the plate 64 of the striker 8.

In addition, the neck 58 is preferably positioned in floating contact inside a protective guide sleeve of the neck 58 when the carboy 2 is placed in position on the stand 4. The configuration of the interior surface of the sleeve 68 as a funnel to facilitate introduction of the neck 58 is to be noted. Lastly, the cushion 62 in question has at least four bearings evenly distributed over the periphery of the body 60 of the carboy 2, preferably ones supported by vertical legs 70 resting axially on a central column of the stand 4 and for this reason favoring the axial impact in question of the load of the carboy 2 on the stand 4.

4. Since the carboy 2 is preferably centered by means of its neck 58, the dispenser preferably has means for absorbing the shock of percussion of the cover 6 of the carboy 2. Such means, mounted between the carboy 2 and the stand 4, is made up of a flexible elastomer insert 72 introduced between the plate 64 and the stand 4.

5. The dispenser has means 80-82-84-76-74 for drainage of sudden discharge which may occur in the vicinity of the striker 8 when the carboy is removed for replacement into a collecting basin 74, one preferably positioned in a low area of the dispenser, that is, below the refrigeration means 26, 30, to prevent any stagnation of beverage capable of causing pollution. The drainage and removal of such outflows of beverage to the basin preferably takes place naturally, by gravity, by way of a drain pipe 76 which connects such drainage means to the basin 74 and which extends vertically relative to the stand 4.

It is also to be noted that the dispenser preferably has a drainage channel 94 for beverage overflows in the area of the tap 92 at least when the beverage is drawn off and enters such drainage line 76.

The collecting basin 74 is advantageously positioned above the cold source 18, for the purpose of evaporation of such beverage discharges by the heat produced by the cold generating means. Preferably, however, the collecting basin 74 incorporates a heating resistance 78, called a dehydrator, of low power but constantly in operation to ensure evaporation of collected drainage outflows, even in the event of prolonged stoppage of the cold source 18, such stoppage possibly ordered by the thermostatic means 40 of the primary exchanger 26.

It will be noted that such drainage means 80-82-84-76-74 and the coiled pipe 22, the configuration of which itself avoids beverage retention areas and whose indicative proportions referred to above result in discharge of the beverage with a dynamic favoring spontaneous cleaning of the internal sources of the coiled pipe 22, in combination constitute overall cleansing means for the dispenser the object of which it is to permit conduct of maintenance operations at longer intervals. It will be understood that this combination of means is preferably supplemented by the array of provisions referred to above designed to limit stagnation of lost discharges of beverage, or leaks, and the presence of untimely discharge retention, at least in the vicinity of the dispensing circuit.

In the embodiment of the drainage means illustrated, such means comprise a duct 80-82-84 communicating on one side with the interior volume of the protective sleeve 68 of the neck 58, at the base of the seat 64-66 on which the neck 58 rests, and in particular at the base of the plate 64 overhung by the neck 58 which rests on the support blocks 66, and on the other side communicating with the drain pipe 76.

Secondly and as a supplement to the foregoing provision, this drain channel 80-82-84 also communicates with a space 82 confined between the exterior surface of the sleeve 68 and the front surface of a housing 86 of the stand 4 which receives it, this space 82 forming a supplementary channel for recovery of discharge of beverage to prevent stagnation of the latter in a space separating the sleeve 68 from the stand 4.

To be noted is the advantageous dual function of the sleeve 68, which simultaneously represents an element protecting and guiding the neck 58 when the carboy 2 is placed in position and which forms part of the means 80-82-84-76-74 for drainage of beverage discharges.

6. The areas of pipes 10,88 carrying beverage which are positioned in an atmosphere at ambient temperature are equipped with decontamination means represented by means 90 for heating pipes to a temperature of the order of at least 800, so that cleaning of the pipes 10, 88, at least in the areas indicated above, is carried out rapidly and simply on the basis of program control means 90 for heating, as a result of which the maintenance operations involved are reduced, this yielding the attendant economic consequences. These heating means are made up, for example, of at least one resistance 90 mounted near, or even wrapped around, the pipe zones in question.

It will be seen that combination of cleansing means 80-82-84-76-74 and 22 with sterilization means 90 contribute in the aggregate to reduction of the cost of maintenance of the device claimed for the invention.

7. The dispenser also comprises at least one of the following provisions:

(a) a cup dispenser fastened to or even incorporated into the stand (not shown in the figure), (b) a second dispensing line 88 communicating upstream from the refrigeration means with the beverage discharge line 10, the second dispensing circuit being provided with a tap 92 for drawing off the beverage at ambient temperature, (c) an electronic timer (not shown in the figure), activation of which is controlled by a sensor of the presence of the carboy 2, in order to indicate, by means of a visual signal, for example, the lapse of a predetermined period of installation of a single carboy 2 in the dispenser.

Thus, to define the inventive step embodied in this invention in general as concisely as possible, we may say that a device dispensing a chilled beverage by gravity feed based on a necked carboy having a percussion cap comprises means of retaining the carboy in inverted position, preferably supported by its neck which is advantageously centered on a striker of the dispenser, such striker comprising a channel for emptying the carboy, which channel communicates with a coiled pipe for conducting the beverage through a secondary exchanger whose heat transfer agent has previously been chilled in a primary exchanger and is taken to the secondary exchanger by means of a pump whose activation is controlled by thermostatic means measuring the temperature of the transfer agent in the secondary exchanger, the primary exchanger comprising a source of heat for maintaining continuous passage of the heat transfer agent to the interior of the closed circuit connecting the primary and secondary exchangers to each other, even when the pump is not activated.

It is to be noted, however, that, generally speaking, these refrigeration means, in particular 18, 26, 30, 32, 34, 36, 38, 40, 42 as defined in paragraph 2 of this description, constitute means of equipment of a beverage dispenser, both by gravity feed by means of stock in reserve and on the basis of the water distribution network, or again on the basis of beverage dispensing under pressure, by means of a pump or of a reserve of beverage kept under pressure in a cask. It will also be seen that, in accordance with these last-named cases, the beverage supply means described in paragraph 1 of this invention, and in particular the percussion means of a necked carboy with the related dispensing channel, are replaced by appropriate connection means.

What is claimed is:

1. A gravity-feed chilled beverage dispenser based on a necked carboy having a percussive inner seal, characterized in that such means comprises means for support of the carboy (2) in inverted position on a striker (8) which has a passage (10) for discharge of the carboy (2) communicating with a coiled pipe (22) for conducting the beverage through a secondary exchanger (20) the heat transfer agent of which has previously been refrigerated in a primary exchanger (26) and which is delivered to the secondary exchanger (20) by means of a pump (36) activation of which is controlled by thermostatic means (38) for measurement of the temperature of the transfer agent in the secondary exchanger (20), the primary exchanger (22) having a heat source (42) for maintaining uninterrupted passage of the transfer agent inside the closed circuit connecting the primary (26) and secondary (20) exchangers to each other, even when the pump (36) is not in operation.

2. A beverage dispenser as specified in claim 1, wherein this dispenser comprises (a) a vertical stand (4), (b) means for retaining a charged removable container (2) in inverted position, such container (2) being in the form of a necked carboy, (c) means of percussion of a sealing cover (6) of the carboy (2), comprising a striker (8) extending vertically and having at least one passage for movement of the beverage out of the carboy (2), such striker (8) also having an air intake passage (12) inside the carboy (2) to compensate for the volume of beverage withdrawn, an the air intake passage communicating with the exterior by means of a beverage check valve (14) and an air filter (16), (d) a beverage chilling device comprising a source of cold (18) for refrigeration of a heat transfer agent kept in balance between its liquid and solid phases, a beverage chilling compartment (20) in which heat exchange takes place between this agent and the beverage, and a beverage dispensing passage (22) communicating with the beverage discharge passage (10), such passage (22) being provided with at least one tap (24) for withdrawing chilled beverage, (e) electric energy supply means, and the chilling device consisting of (a) a primary exchanger (26) in which chilling of the heat transfer agent takes place, the primary exchanger (26) having a primary exchange compartment (28) containing such heat transfer agent, and such source (18) of cold, (b) a secondary exchanger (30) having a secondary exchange compartment (20) containing such transfer agent and at least partly such chilled beverage dispensing line (10-22), such line being in the form of a coiled pipe (22) extending vertically, (c) a closed hydraulic circuit comprising a primary compartment (26) and a secondary compartment (30) connected to each other by passages called delivery (32) and return (34) lines respectively for conveying such transfer agent between the primary (26) and secondary (30) exchangers by means of a pump (36) mounted on the circuit, (d) thermostatic means (38) situated in the secondary compartment (20) for measurement of the temperature of the transfer agent present, such thermostatic means (38) constituting control means for activating or stopping the pump (36) so as to cause circulation or suspension of circulation of the agent in this closed circuit, and (e) means of ensuring coexistence of liquid and solid phases of the heat transfer agent, comprising thermostatic means (40) situated in the primary compartment for activating or suspending production of cold (18) and a source of heat (42) constituting means for ensuring continuity in the circuit of a heat transfer agent as a liquid.

3. A beverage dispenser as specified in claim 2, wherein such static heat source is made up of a derivative circuit (42) of the heat transfer agent for keeping outside the primary compartment (28) a certain amount of heat transfer agent inside such closed circuit.

4. A beverage dispenser as specified in claim 3, wherein such derivative circuit (42) forms a one-piece assembly with the primary compartment (28) blow molded from a plastic around rigid intake (46) and discharge (48) pipes of a coiled pipe (44) making up the cold source evaporator (18) and around a tube (50) housing corresponding thermostatic means (40), the coiled pipe (44) being mounted inside the primary compartment (28), which contains the heat transfer agent.

5. A beverage dispenser as specified in claim 2, wherein such closed circuit is kept under atmospheric pressure and is made up of primary (28) and secondary (20) compartments and of the delivery (32) and return (34) lines, the pump (36) being mounted on either of the latter.

6. A beverage dispenser as specified in claim 2, wherein the carboy (2) is kept charged by the stand (4) when in the inverted position by its neck (58), which rests on a seat (64, 66) of the striker (8), on which striker (8) the neck (58) is positioned for centering the carboy (2) on the stand (4) by means of its neck, the body (60) of the carboy being in contact with the stand (4) by way of flexible elements (62).

7. A beverage dispenser as specified in claim 6, wherein it comprises means of absorbing the shock of percussion of the cover (6) of the carboy (2) including such flexible elements and a flexible block (72) inserted between the seat (64) of the neck (68) and the stand (4).

8. A beverage dispenser as specified in claim 6, wherein it comprises means for drainage of unforeseen discharge of beverage in the vicinity of the striker (8) toward a collecting basin (74), drainage and delivery of such beverage discharges to the basin (74) taking place naturally by gravity, through a drain pipe (76) which connects such drainage means to the basin.

9. A beverage dispenser as specified in claim 8, wherein the collecting basin incorporates a heating resistance (78) of low power but in operation at all times to ensure evaporation of collected beverage discharges, even in the event of prolonged interruption of the source of cold (18) controlled by the thermostatic means (40) of the primary exchanger (26).

10. A beverage dispenser as specified in the claim 6, wherein the draingage means comprises a duct (80-82-84) communicating on one side with the interior volume of a protective sleeve (68) of the neck (58), at the base of the seat (64-66) on which the neck (58), at the base of the seat (64-66) on which the neck (58) rests, and on the other side with the drain pipe (76).

11. A beverage dispenser as specified in claim 6, wherein the areas of the pipes carrying the beverage which are situated in an atmosphere at ambient temperature are provided with decontamination means made up of pipe heating means made up of at least one resistance (90) wrapped around such pipe areas.

* * * * *